US005524716A

United States Patent [19]

Wachholz

[11] Patent Number: 5,524,716

[45] Date of Patent: Jun. 11, 1996

[54] BI-DIRECTIONALLY EXTENSIBLE TOOL DRIVING APPARATUS

[75] Inventor: Wayne W. Wachholz, Young America, Minn.

[73] Assignee: Wachholz, Inc., Young America, Minn.

[21] Appl. No.: 398,607

[22] Filed: Mar. 6, 1995

[51] Int. Cl.[6] ..... F21B 19/14

[52] U.S. Cl. ..... 175/52; 175/122; 175/203; 175/162; 173/147

[58] Field of Search ..... 175/20, 52, 113, 175/122, 162, 203, 85; 173/147, 13

[56] References Cited

U.S. PATENT DOCUMENTS

| | | | |
|---|---|---|---|
| 2,849,212 | 8/1950 | Robbins | 175/122 |
| 4,020,909 | 5/1977 | Airaudo | 173/147 |
| 4,258,796 | 3/1981 | Horning et al. | 175/52 |
| 4,606,155 | 8/1986 | Bukovitz et al. | 173/193 X |
| 5,174,389 | 12/1992 | Hansen | 175/52 |
| 5,199,507 | 4/1993 | Westmoreland | 173/147 |
| 5,213,169 | 5/1993 | Heller | 175/122 |
| 5,263,545 | 11/1993 | Tudora et al. | 175/52 |

*Primary Examiner*—Frank S. Tsay
*Attorney, Agent, or Firm*—Schroeder & Siegfried

[57] ABSTRACT

A tool driving apparatus having an elongated mast which is collapsibly mounted on a transportable supporting base therefor, wherein the mast has a movable carriage slidably mounted thereon for movement along the length thereof. A first piston is mounted to the supporting base and is drivingly connected to the carriage mounted on the mast for providing slidable movement thereof, and a second piston is carried by the carriage and is drivingly connected to a separate tool, such as a soil probe. The first piston is disposed opposite relative to the second piston, such that extension of the first piston is in a direction opposite to that of the second, and whereby retraction of the first piston and extension of the second piston will cause the tool to be driven in one direction, and extension of the first piston and retraction of the second piston will cause the tool to be retracted in the opposite direction. For transportation of the tool driving apparatus, the mast collapses on the supporting base, which is equipped with wheels for transporting the same.

26 Claims, 6 Drawing Sheets

23
21
19
17
1
49
27
39
35
45
71
69
47
43
57
65
67
63
55
11
3
7
61
11
59
41
13
25
11
7
9
5
11

23
27
39
35
1
47
51
45
53
71
43
75
69
73
37
65
63
57
55
79
67
41
3
13
59
25
77
11
5
11
9
7

23
27
39
47
35
1
51
71
53
45
69
37
43
71
65
75
63
55
57
79
73
41
13
3
67
59
25
11
9
5
11
7
77

23
19
1
27
39
35
45
47
69
37
71
43
51
65
53
63
55
13
79
3
57
41
67
59
25
11
9
5
11
75
7
73
77

BI-DIRECTIONALLY EXTENSIBLE TOOL DRIVING APPARATUS

I. DESCRIPTION

Background of the Invention

The instant invention is related generally to the art of providing a tool driving apparatus for applying a substantially straight-line force to a tool being driven thereby. More particularly, the instant invention is directed to a tool driving apparatus which is constructed in such manner as to provide the desired stroke capability through the use of a smaller, less expensive and more compact and maneuverable drive arrangement for the tool.

Conventional devices for imparting a substantially straight-line driving motion to a tool, such as a soil probe, typically involve the use of a single large piston which imparts an axial driving force to the tool being used. For applications requiring tool movement over relatively large distances, a piston of equal length has heretofore been typically used. For instance, to drive a soil probe a distance of 6 feet into the earth, a conventional tool driving apparatus typically uses a drive piston of at least 6 feet in length. When fully extended, the outer piston cylinder and piston rod together extend 12 feet in length, thereby requiring a supporting mast of at least 12 feet in height to avoid the piston rod from striking the ground. Thus, the rear end of the piston cylinder is at least 12 feet above ground level, requiring a rigid supporting mast therefor.

Of course, such a long, rigid supporting mast and large piston makes the assembly as a whole very difficult to maneuver and transport. Also, a typical 12-foot piston generally requires a 3- to 5-inch diameter shaft or piston rod, which makes the tool driving apparatus extremely heavy and cumbersome for handling and transportation. Additionally, the cost of a special purpose piston capable of providing a 6-foot stroke is substantial in comparison with that of a smaller more standard piston of approximately 3 feet in length.

As can be seen from the above, there are significant problems associated with such conventional tool driving devices in that the required pistons to provide the desired drive stroke require large, expensive and cumbersome pistons that are extremely heavy and cost prohibitive. There is a distinct need to provide such a drive apparatus which can utilize smaller, lighter and less expensive pistons that will provide the desired drive stroke while at the same time can be constructed in a more compact arrangement for easier handling and transportation thereof. It is with this objective in mind that I have developed my new bidirectionally extensible and collapsible tool driving apparatus as described and claimed hereinafter.

BRIEF SUMMARY OF THE INVENTION

With the above objectives in mind, I have developed a bidirectionally extensible tool driving apparatus which is relatively compact in size, and is collapsible, thereby facilitating easy maneuverability and transportability thereof. My new tool driving apparatus includes a vehicular support base which is capable of being connected to a drive vehicle for transportation thereof. The vehicular support base includes corner support jacks which can be used for leveling and support purposes during operation of the tool driving apparatus.

Supported in upright position on the supporting base is an elongated mast constructed preferably of a pair of parallel, interconnected but spaced rigid tubular members which provide the needed stability for the drive apparatus. Carried on the mast is a carriage which is slidably movable thereon via the use of a first retractable extender or piston that is also connected to the lower portion of the mast adjacent the supporting base. The drive shaft or piston rod of the first piston is connected in driving relation to the carriage which is carried by the mast, and is oriented such that extension of the piston rod is in an upward direction, thereby causing the carriage to slide upwardly on the mast. Retraction of the first piston, therefore, causes the carriage to move downwardly on the mast.

A second retractable extender or piston is mounted on the carriage that slides along the mast, and is oriented such that the movable drive shaft or piston rod thereof extends downwardly in a direction opposite to that of the first piston. The terminal end of the piston rod of the second piston is connectable to a tool, such as a soil probe, which is to be driven thereby. Each of the pistons are preferably hydraulically driven, with an appropriate size drive pump and control valves carried on the vehicular support base.

The lower end of the mast is pivotally jointed to allow the mast to be easily collapsed for ease in transportation. A locking bar extending between the first piston mounted on the mast and the frame of the vehicular support base locks the mast in upright position during use thereof.

Although there are many conceivable uses for my new tool driving apparatus, for purposes of illustration, its use in connection with a soil piercing tool, such as a soil probe, will be described. In operation, with the mast locked in upright position, and the first piston carried by the mast being fully extended, the movable carriage on the mast will be positioned adjacent the top end thereof. Upon activation of the second piston mounted to the carriage, the piston rod thereof, and consequently the soil piercing tool connected thereto, will be driven downwardly into the soil of the earth. Use of a soil gatherer on the terminal end of the soil piercing tool allows the operator to gather needed samples of soil for purposes of conducting soil testing.

Continued retraction and extension of the second piston will gather further samples of the soil for the operator. Once full extension of the second piston is realized, additional sampling of the soil to lower depths may be accomplished through retraction of the first piston, which consequently drives the carriage and second piston further downwardly. This process may be continued as necessary until such time that the second piston is fully extended and the first piston is fully retracted, thereby having driven the soil sampler into the earth a depth corresponding to the combined length of reach of both of the first and second pistons of the drive apparatus.

Further extension or reach of the soil piercing tool may be effected by adding extensions to the soil piercing tool, thereby allowing the soil sampler to be driven even deeper into the earth's surface. Through the repeated extension and retraction of both the first and second pistons, and use of extensions to the soil piercing tool, sampling of the soil at a desired depth may be obtained.

By using my bidirectionally extensible tool driving apparatus, substantially smaller pistons that utilize less space, are lighter in weight, and are substantially less costly and easier to maneuver and transport, may be used effectively in applications where substantially larger and more costly pistons have heretofore been used. The arrangement of such pistons, as described above, effectively reduces the required length of the supporting mast by two-fold. For example, a conventional driving apparatus having an enlarged 6-foot piston mounted on a 12-foot mast may now be replaced with a pair of more standard 3-foot pistons mounted on a 6-foot mast. Arranging such pistons as described above will provide the same drive stroke as the single larger piston, but is much more compact and easy to handle for storage and transportation, and is less costly to purchase and/or repair.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
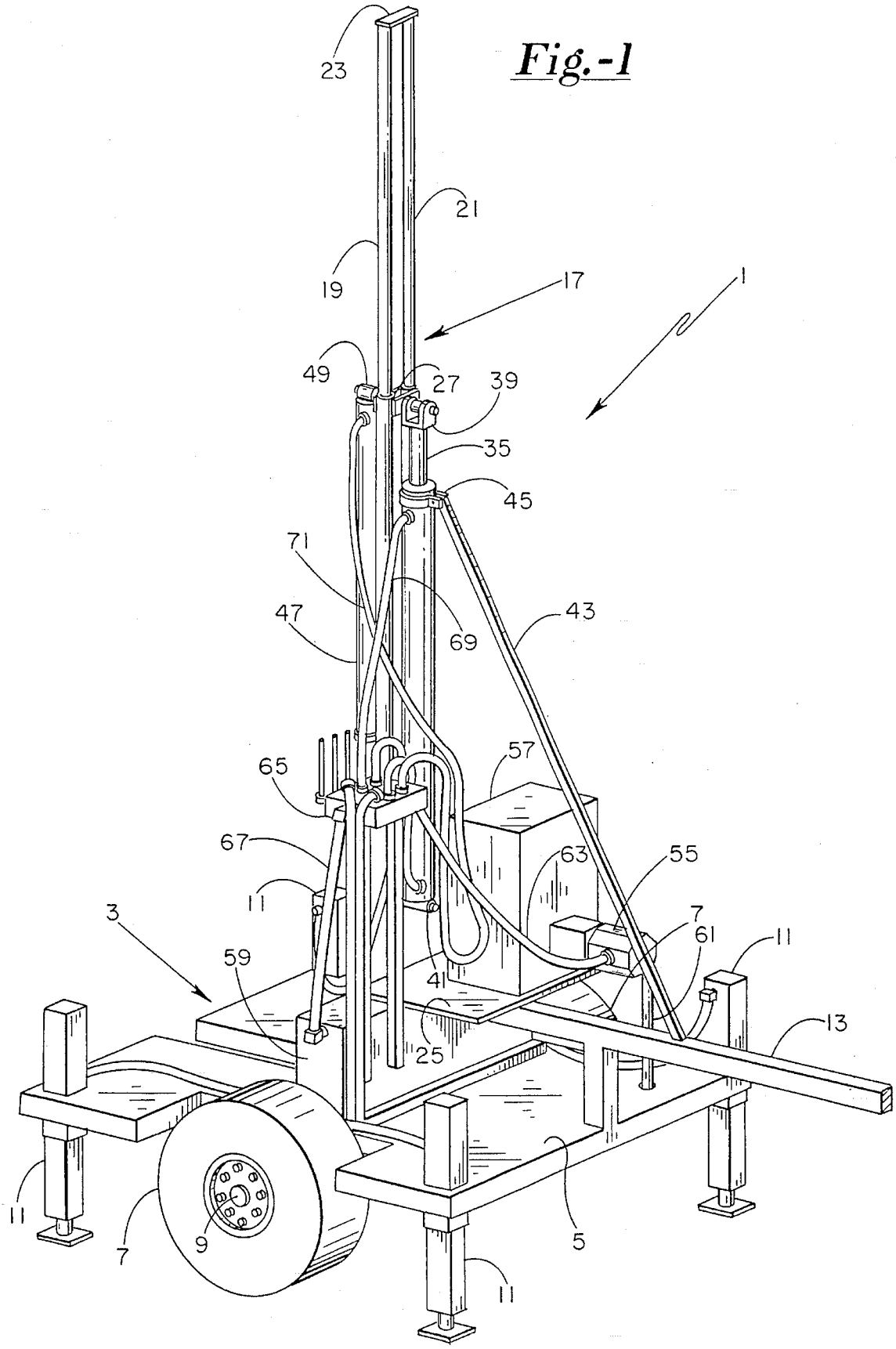
FIG. 1 is a perspective view of my new bidirectionally extensible tool driving apparatus, showing the assembly thereof on a vehicular type support apparatus.

As shown in FIG. 1, my new bidirectionally extensible tool driving apparatus 1 includes a vehicular support base 3 comprising platform 5 with wheels 7 supported by axle 9 which is mounted on platform 5 in a conventional manner known in the art. Platform 5 has corner support jacks 11 disposed at each of its corners for leveling and support purposes during the operation of the tool driving apparatus 1. Extending outwardly from platform 5 is an elongated hitch pole 13 having a hitch assembly 15 (see FIG. 5) disposed at its outer terminal end. For transportation of the tool driving apparatus 1, hitch assembly 15 may be cooperatively connected to the trailer hitch (not shown) of an automobile or truck for easy transportation thereof.

Supported in normally upright position upon platform 5 is an elongated mast 17 which is preferably constructed of a pair of spaced, parallel extending, elongated rigid tubular members 19 and 21 which are interconnected at their upper terminal end via connecting plate 23. The lower terminal end of mast 17 is rigidly secured to support plate 25 which is supported by hitch pole 13 and, therefore, ultimately supported by platform 5.

Figure 2:
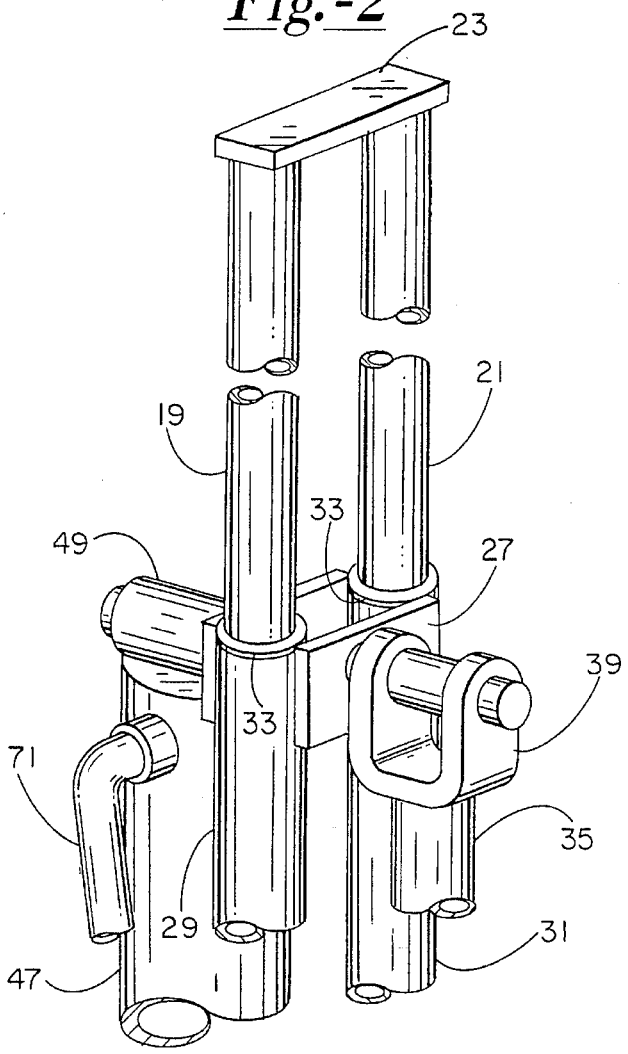
FIG. 2 is a partial blown-up perspective view showing the engagement of the movable carriage on the supporting mast, with a first piston connected thereto in driving relation.
Figure 3:
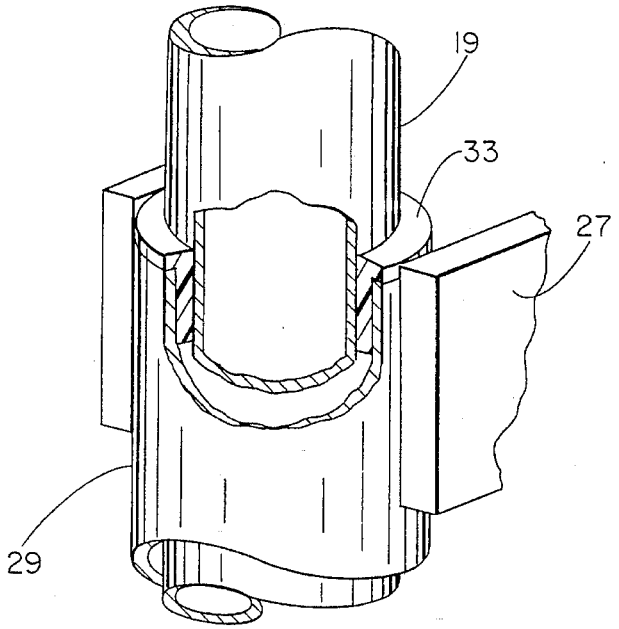
FIG. 3 is a further blown-up perspective view showing in closer detail a broken-away portion of the carriage and mast which is disclosed in FIG. 2.

Carried in slidably movable relation on mast 17 is a carriage 27. As best shown in FIGS. 2 and 3, carriage 27 is comprised of a pair of open tubular members 29 and 31 which are disposed in telescoping relation over tubular members 19 and 21 which comprise mast 17. Disposed between mast tubular member 19 and telescoping carriage tubular member 29, and between mast tubular member 21 and telescoping carriage tubular member 31, are plastic ring-shaped cylinder liners 33 which have an inner diameter only slightly greater than the outer diameter of tubular members 19 and 21 of mast 17. Such plastic liners 33 facilitate easy slidable movement of carriage 27 along mast 17.

Connected to the upper end of carriage 27 for causing slidable movement thereof along mast 17 is piston rod 35 of a first retractable extender or piston 37. Piston 37 is rigidly secured to the lower portion of mast 17, and rigidly secured to carriage 27 via connecting means 39 at the terminal end of piston rod 35. The lower end of piston 37 is secured to mast 17 via connector means 41, and the upper portion of piston 37 is held in stable relation to mast 17 via support brace 43 which extends angularly downward from the upper end 45 of piston 37 to hitch pole 13, where brace 43 is connected in secure relation. As is evident from FIG. 1, piston 37 is positioned such that, upon activation thereof, extension of piston rod 35 is in an upward direction, thereby causing slidable movement of carriage 27 upwards along mast 17.

Figure 4A:
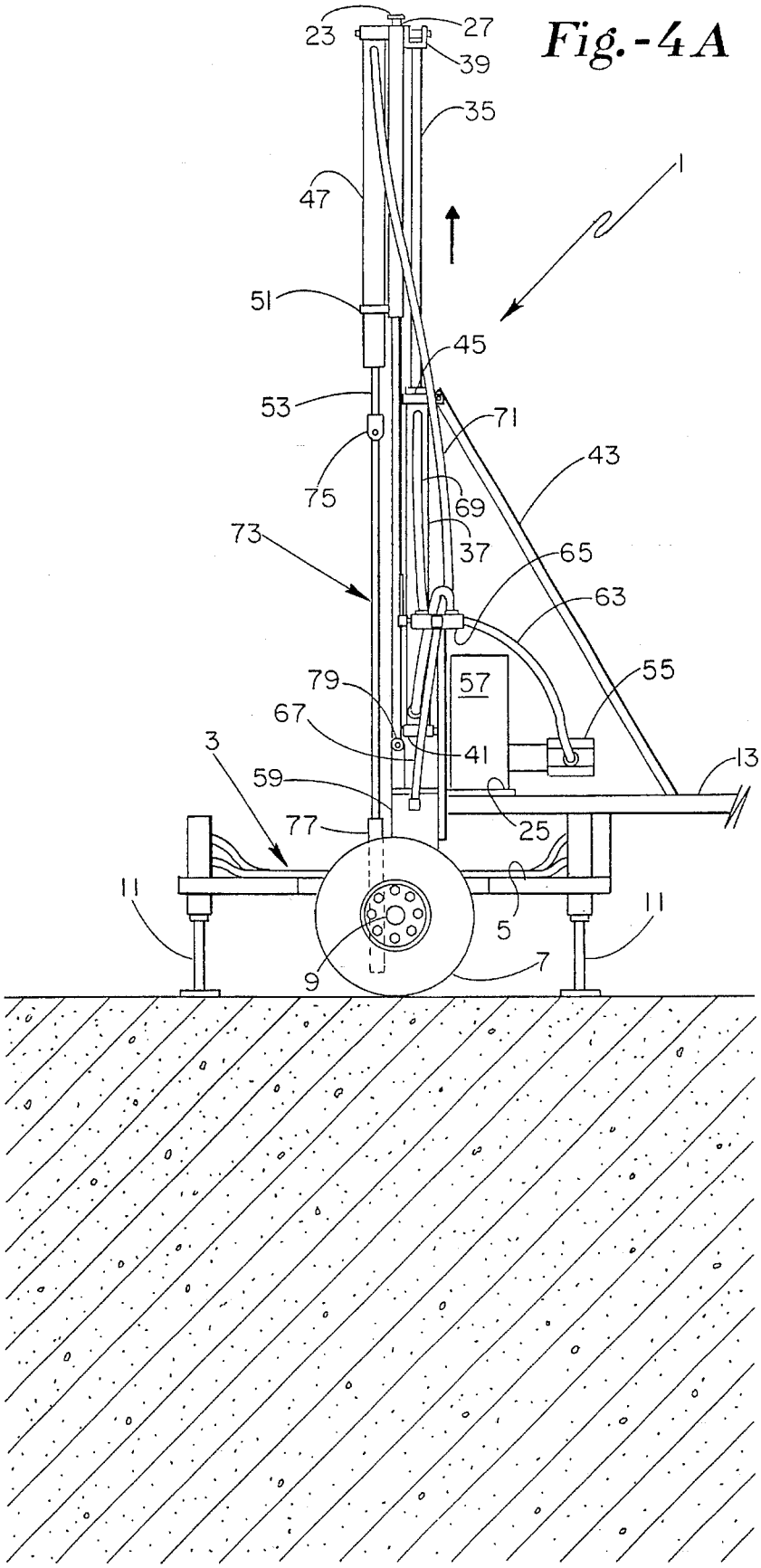
FIG. 4A is a side elevational view of my new bidirectionally extensible tool driving apparatus, showing the relative positioning of the drive pistons to effect full retraction of the tool connected thereto.
Figure 4B:
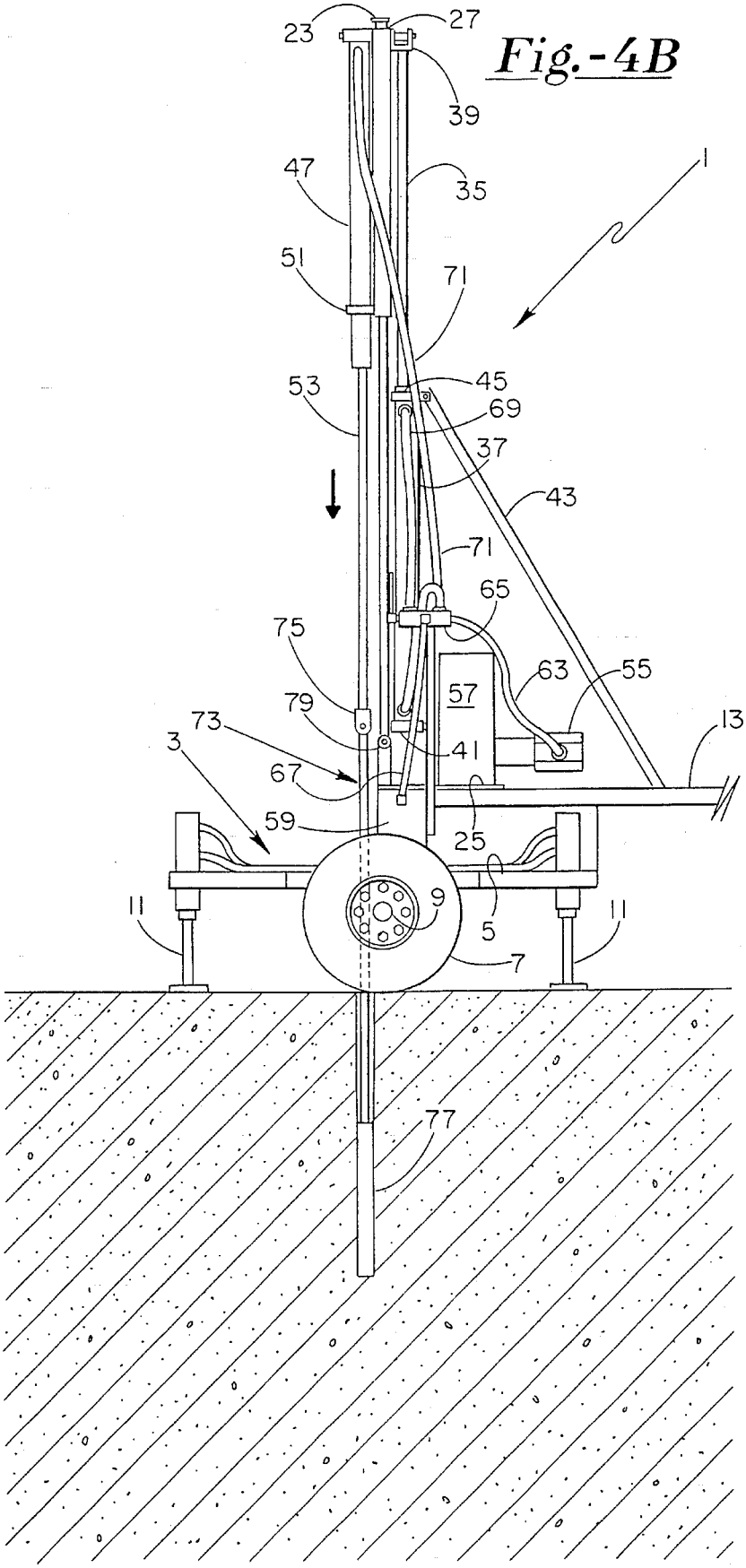
FIG. 4B is a side elevational view of my new bidirectionally extensible tool driving apparatus, showing the operation thereof, wherein a soil probe is initially driven downwardly through extension of the piston carried on the carriage.
Figure 4C:
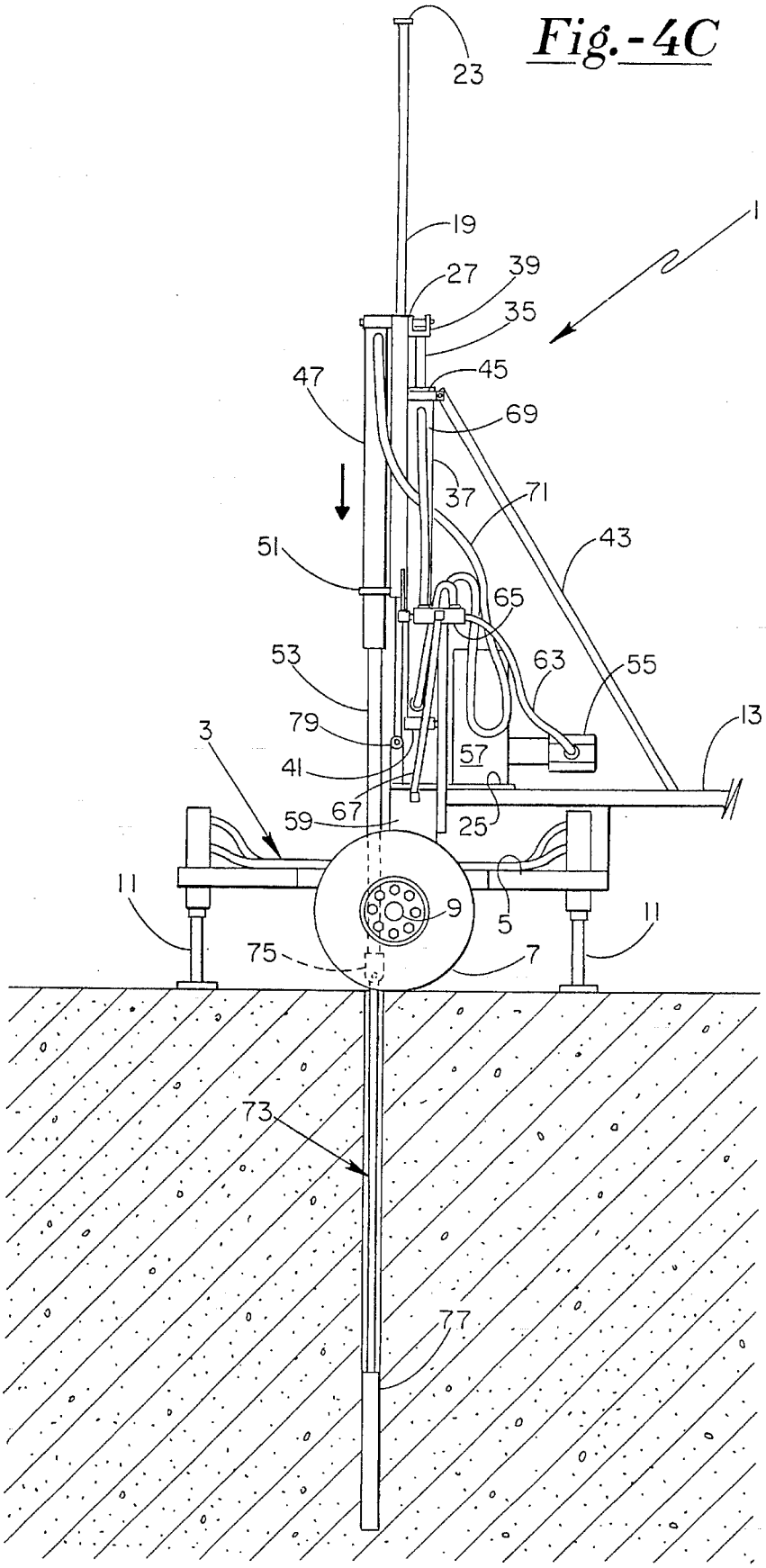
FIG. 4C is a side elevational view further showing the operation of my new bidirectionally extensible tool driving apparatus, wherein a soil probe connected thereto is driven downwardly to its furthest extent via full extension of the piston carried on the carriage, and full retraction of the carriage driving piston.

As best shown in FIGS. 4A through 4C, mounted on carriage 27 on the opposite face of mast 17 as piston 37, is a second retractable extender or piston 47 which is rigidly secured to carriage 27 at its upper end via a suitable connector means 49, and at its lower end via another suitable connector means 51. Cylinder 47 is disposed opposite relative to cylinder 37, such that piston rod 53 of piston 47 is extensible downwardly from carriage 27, as shown in FIG. 4B.

Pistons 37 and 47 are preferably hydraulically operated through the use of a two-stage hydraulic pump 55 which is driven by a horizontal shaft engine 57. Hydraulic oil for the pistons is stored in hydraulic oil tank 59, which is carried by platform 5 and disposed beneath support plate 25 in supporting relation thereto. The horizontal shaft engine 57 and hydraulic pump 55 are mounted on support plate 25, and are supported thereby.

As shown in FIG. 1, oil suction line 61 extends from the bottom of oil tank 59 to pump 55, where the oil is fed through feed line 63 to the hydraulic control valves 65. The return oil line 67 allows oil to return from control valve 65 to the hydraulic oil tank 59. Hydraulic hoses 69 and 71 extend from control valves 65 to hydraulic pistons 37 and 47, respectively, and provide such pistons with hydraulic pressure upon activation of the appropriate valve 65.

The improved operation and advantages of my bidirectionally extensible tool driving apparatus 1 are best shown in FIGS. 4A through 4C, wherein the operation thereof is shown in connection with a soil probing tool 73. As shown therein, my new tool driving apparatus 1 is substantially compact in size in comparison with a conventional tool driving apparatus which utilizes a single elongated cylinder to drive a tool connected thereto. By utilizing two half-size cylinders and arranging the same as shown in the accompanying drawings, the required length of the supporting mast is effectively reduced by approximately one-half the size. For instance, for a given conventional tool driving apparatus which utilizes a six-foot long hydraulic cylinder, such cylinder must be supported on a mast which extends approximately 12 feet in height, such that extension of the cylinder will not cause the piston rod thereof to come in contact with the ground. With the tool driving apparatus as shown in the accompanying drawings, a pair of more standard and less costly 3-foot hydraulic pistons may be used and mounted on a mast extending only approximately 6 feet above the platform to which it is secured, which substantially reduces the size of the tool driving apparatus, and facilitates easy maneuverability and transportability thereof.

As shown in FIG. 4A, the tool driving apparatus 1 is positioned such that a tool 73, which is connected to the terminal end of piston rod 53 of hydraulic piston 47 via a suitable connector 75, is disposed in its most retracted position. Piston 47, which is connected to carriage 27, and movable therewith, being fully retracted, draws tool 73 inward toward piston 47 as far as possible. It can also be seen that piston 37 is fully extended with the terminal end of piston rod 35 and, consequently, the top end of carriage 27 being driven to the top of mast 17. Through the combined extension of piston 37 and retraction of piston 47, it can be seen from FIG. 4A that the tool 73 connected thereto is retracted to its uppermost position away from the ground upon which the tool driving apparatus 1 rests.

As shown in FIG. 4B, upon activation of the appropriate control valve 65, hydraulic fluid pressure may be provided through line 71 to piston 47, thereby causing extension of piston rod 53, and consequent extension of the tool 73 being driven thereby. Through repeated activation and deactivation of the appropriate control valve 65, piston 47 may be extended and retracted as desired to drive the attached tool 73 to the desired point of extension, while piston 37 remains unchanged from its initial fully extended position.

For further extension, the appropriate control valve 65 for piston 37 may be activated to cause retraction of piston rod 35 which is connected to carriage 27. As shown in FIG. 4C, upon retraction of piston rod 35, carriage 27 is driven downwardly, thereby driving tool 73 further downwardly, as needed. Through continued retraction and extension of piston 37, carriage 27, and consequently tool 73, may be extended or retracted further to the desired extent of the user.

Although it is conceivable for my new bidirectionally extensible tool driving apparatus 1 to be used in many different applications where it is necessary to drive a tool to an extended position, for exemplary purposes, tool 73 shown in FIG. 4 constitutes a soil probe which is designed for use in sub-soil probing and obtaining soil samples. Through the use of such a soil probe 73, soil borings may be taken from loom soils, sand soils, clay soils, packed soils, roadbeds, and even partially frozen soils. My new tool driving apparatus 1 substantially eliminates the strain of manual labor methods for performing the same task.

To operate my bidirectionally extensible tool driving apparatus 1 with an attached soil probe 73, the platform 5 is transported to the desired area for soil sampling, and the support jacks 11 are lowered to secure and stabilize the platform 5 during the soil probing operation. By starting motor 57 and activating the appropriate control valve 65, piston 37 may be extended such that carriage 27 is positioned as shown in FIG. 4A, where soil probe 73 is above ground level. Through activation of the appropriate valve 65 for piston 47, piston rod 53 will extend downwardly, as shown in FIG. 4B, thereby driving the soil probe 73 with soil sampler 77 into the ground to obtain the first sample thereof. Piston 47 may be retracted to raise the soil sampler 77 above ground and remove the soil sample therefrom. For deeper sampling, the soil probe 77 is reinserted into the same hole, and driven deeper into the ground by further extension of piston 47.

The above process may be continued, and deeper sampling may be obtained through retraction of piston 37, which will drive carriage 27, and consequently the soil probe 73 even further into the ground. By repeating this process, soil sampling at the desired depth may be obtained. If deeper sampling is still necessary, extension rods (not shown) for soil probe 73 are available to increase the length thereof to reach the desired depth.

Figure 5:
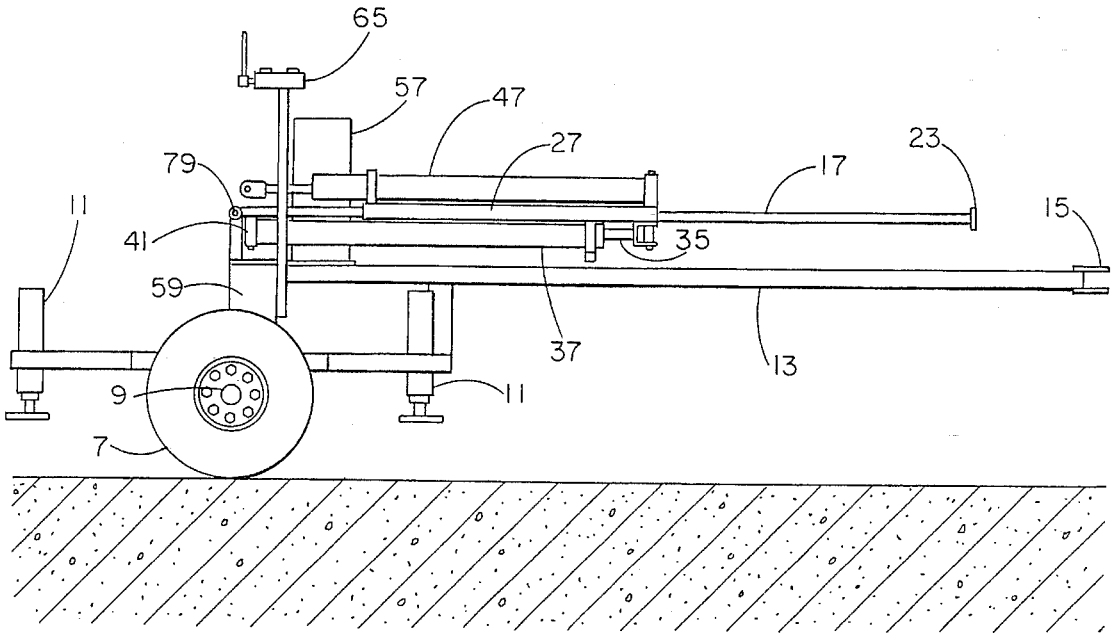
FIG. 5 discloses a side elevational view of my new bidirectionally extensible tool driving apparatus, showing the mast hinge assembly which allows the mast to be collapsed for convenient transportation and storage thereof.

When use of my bidirectionally extensible tool driving apparatus 1 has been completed, the mast 17 is collapsible at hinge assembly 79, as shown in FIG. 5. Due to the relatively small compact size of my tool driving apparatus and its ability to be collapsed into a smaller unit, storage, maneuverability and transportability of my new tool driving apparatus is greatly enhanced over conventional devices of this sort.

It will, of course, be understood that various changes may be made in the form, details, arrangement and proportions of the parts without departing from the scope of the invention which comprises the matter shown and described herein and set forth in the appended claims.

I claim:

1. A bi-directionally extensible tool driving apparatus, comprising:

(a) a support base:

(b) an elongated mast of predetermined length supported on said base;

(c) a carriage mounted on said mast in movable relation thereon;

(d) a first retractable extender with a predetermined reach connected between said base and said carriage for providing movement of said carriage back and forth along said mast;

(e) a second retractable extender with a predetermined reach mounted on said carriage for movement therewith along said mast;

(f) a tool connected to said second retractable extender in driven relation thereto;

(g) control means connected to said first and second retractable extenders for controlling retraction and extension thereof;

(h) said second retractable extender being positioned on said carriage such that extension of said second retractable extender is in a direction opposite to that of said first retractable extender, thereby facilitating drivability of said tool a distance at least as long as the combined reach of said first and second retractable extenders.

2. The tool driving apparatus defined in claim 1, wherein said support base is constructed to be transportable.

3. The tool driving apparatus defined in claim 1, wherein said mast is comprised of a pair of laterally spaced upstanding rigid tubular members which are fixedly secured together at opposite ends thereof.

4. The tool driving apparatus defined in claim 3, wherein said carriage is comprised of a sleeve which is slidably movable along said rigid tubes which comprise said mast.

5. The tool driving apparatus defined in claim 1, wherein said first retractable extender is rigidly secured to said base adjacent said mast.

6. The tool driving apparatus defined in claim 1, wherein said first retractable extender is rigidly secured to said mast adjacent said base.

7. The tool driving apparatus defined in claim 1, wherein said first and second retractable extenders are each comprised of a piston.

8. The tool driving apparatus defined in claim 7, wherein said mast includes a pivotal joint for facilitating raising and lowering of said mast between an upright and generally horizontal position.

9. The tool driving apparatus defined in claim 1, wherein said first retractable extender is positioned adjacent said base such that extension thereof causes vertical upward movement of said carriage on said mast and retraction of said first extender causes vertical downward movement of said carriage on said mast.

10. The tool driving apparatus defined in claim 1, wherein said tool comprises a soil piercing means, and said second retractable extender is carried by said carriage in such position that extension thereof causes said soil piercing means to penetrate the soil, and retraction thereof causes said soil piercing means to withdraw from the soil.

11. The tool driving apparatus defined in claim 10, wherein said soil piercing means comprises a rigid rod having a lower end which carries a rigid sampling tube thereon.

12. The tool driving apparatus defined in claim 11, wherein said sampling tube is generally conically shaped and positioned on said rigid rod such that the walls of said sampling tube diverge outwardly away from said rod.

13. The tool driving apparatus defined in claim 10, wherein said soil piercing means has a soil piercing end which carries a soil gatherer thereon.

14. The tool driving apparatus defined in claim 10, wherein retraction of said first retractable extender or extension of said second retractable extender causes said soil piercing means to probe the soil, and extension of said first retractable extender or retraction of said second retractable extender causes said soil piercing means to withdraw from the soil.

15. The tool driving apparatus defined in claim 1, wherein said first and second retractable extenders are comprised of pistons, and said control means includes a motorized pump with a pair of control valves for activating said first and second pistons.

16. A bi-directionally extensible tool driving apparatus, comprising:

(a) a supporting base;

(b) an elongated mast supported in vertically upstanding position on said base;

(c) a carriage mounted on said mast in slidably movable relation thereto;

(d) a first retractable extender connected between said base and said carriage for providing sliding movement of said carriage along said mast;

(e) a second retractable extender mounted on said carriage for movement therewith along said mast;

(f) control means for controlling retraction and extension of said first and second retractable extenders;

(g) said second retractable extender being drivingly connected to a tool, whereby extension or retraction of either of said first or second retractable extenders causes driving movement of said tool.

17. The tool driving apparatus defined in claim 16, wherein said first retractable extender and said second retractable extender are comprised of first and second pistons, respectively, and said control means includes a motorized pump with control valves for operating said first and second pistons.

18. The tool driving apparatus defined in claim 16, wherein said first retractable extender is oppositely disposed relative to said second retractable extender, such that each is extensible in an opposite direction.

19. The tool driving apparatus defined in claim 16, wherein said first retractable extender is mounted to said mast adjacent said supporting base in such position as to be extensible upwardly, and said second retractable extender is mounted to said carriage in such position as to be extensible downwardly.

20. The tool driving apparatus defined in claim 16, including means for collapsing said mast.

21. The tool driving apparatus defined in claim 20, wherein said mast includes a pivotal joint to facilitate collapsing the same to a generally horizontal position.

22. The tool driving apparatus defined in claim 16, wherein said tool is comprised of an elongated rigid soil piercing rod having a lower end to which a tubular member is attached, said tubular member constituting a soil sampler.

23. The tool driving apparatus defined in claim 22, wherein said tubular member is generally conical in shape, and the outer walls of said tubular member diverge outwardly and downwardly from said lower end of said rigid rod.

24. The tool driving apparatus defined in claim 22, including at least one lengthening rod which is attachable to said rigid soil piercing rod for lengthening the same.

25. A soil probe, comprising:

(a) a portable support base;

(b) an elongated mast supported in upright position on said base;

(c) a first piston being connected to said base and being extensible and retractable along a plane generally parallel with the length of said mast;

(d) a second piston being carried on said mast in slidably movable relation thereto, said first piston being drivingly connected to said second piston to cause slidable movement of said second piston along said mast upon extension or retraction of said first piston;

(e) said second piston being drivingly connected to a soil piercing means, said soil piercing means including a tubular soil sampler which gathers soil upon penetration of the soil thereby as a result of activation of at least one of said first or second pistons; and (f) control means including a motorized pump and control valves for controlling extension and retraction of said first and second pistons.

26. The tool driving apparatus defined in claim 25, wherein said first and second pistons are oppositely disposed relative to one another such that extension of said first piston is in the opposite direction of that of said second piston.

* * * * *